US008502747B2

(12) United States Patent
Chang et al.

(10) Patent No.: US 8,502,747 B2
(45) Date of Patent: Aug. 6, 2013

(54) DIPOLE ANTENNA ASSEMBLY

(75) Inventors: Sheng-Che Chang, Tu-Cheng (TW); Chang-Ching Lin, Tu-Cheng (TW); Chun-Chieh Tseng, Tu-Cheng (TW); Yun-Cheng Hou, Tu-Cheng (TW); John Chow, Saratoga, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 331 days.

(21) Appl. No.: 12/906,180

(22) Filed: Oct. 18, 2010

(65) Prior Publication Data

US 2011/0279341 A1 Nov. 17, 2011

(30) Foreign Application Priority Data

May 12, 2010 (TW) ..... 099208859

(51) Int. Cl.
*H01Q 9/16* (2006.01)

(52) U.S. Cl.
USPC ..... 343/822; 343/795; 343/700 MS

(58) Field of Classification Search
USPC ..... 343/820, 821, 822, 700 MS, 795, 343/79, 793
See application file for complete search history.

(56) References Cited

U.S. PATENT DOCUMENTS

| | | | | |
|---|---|---|---|---|
| 4,860,019 | A * | 8/1989 | Jiang et al. | 343/795 |
| 7,095,382 | B2 * | 8/2006 | Surducan et al. | 343/793 |
| 7,501,955 | B2 * | 3/2009 | Forster et al. | 340/572.7 |
| 7,564,423 | B2 | 7/2009 | Ke et al. | |
| 7,659,863 | B2 * | 2/2010 | Kai et al. | 343/795 |
| 2004/0140941 | A1 * | 7/2004 | Joy et al. | 343/795 |
| 2006/0022888 | A1 * | 2/2006 | Cheng | 343/795 |

* cited by examiner

*Primary Examiner* — Hoanganh Le
(74) *Attorney, Agent, or Firm* — Ming Chieh Chang; Wei Te Chung

(57) ABSTRACT

A dipole antenna assembly (100, 200) includes a dipole antenna (10, 30) and a feeding element (20, 40) connecting with the dipole antenna. The dipole antenna includes a radiation portion (12, 32), a ground portion (13, 33) and a circuit (14, 34). The feeding element includes a central conductor (21, 41) soldered on the radiation portion at a first position, and a shielding layer (23, 43) soldered on the ground portion at a second position. The circuit includes one end connecting with the radiation portion at the first position, and another end connecting with the ground position at the second position for impedance matching.

7 Claims, 6 Drawing Sheets

DIPOLE ANTENNA ASSEMBLY

BACKGROUND OF THE INVENTION

1. Field of the Invention

The present invention relates to a dipole antenna assembly, and more particularly to an internal dipole antenna assembly.

2. Description of Related Arts

U.S. Pat. No. 7,564,423, issued to Ke et al. on Jul. 21, 2009 and entitled with "print dipole antenna", discloses a related art. According to the disclosure, a printed dipole antenna used in an electronic device comprises a PCB comprising a plurality of through holes, a grounding element located on one side of the PCB, a radiating element located on common side of the PCB with the grounding element, and a short circuit element located on the other side of the PCB and electrically connected with the radiating element and the grounding element by said through holes.

The short circuit and radiating element are disposed on two opposite surfaces of the PCB, and connect to each other by through holes. Such structure of the antenna will increase the cost of manufacturing the antenna.

Hence, an improved dipole antenna assembly is desired.

SUMMARY OF THE INVENTION

An object of the present invention is to provide a dipole antenna assembly having a simply structure and improved electrical performance.

To achieve the above-mentioned object, a dipole antenna assembly includes a dipole antenna and a feeding element connecting with the dipole antenna. The dipole antenna includes a radiation portion, a ground portion and a circuit. The feeding element includes a central conductor soldered on the radiation portion at a first position, and a shielding layer soldered on the ground portion at a second position. The circuit includes one end connecting with the radiation portion at the first position, and another end connecting with the ground position at the second position for impedance matching.

According to one aspect of the present invention, the dipole antenna has a simply structure and the circuit has a function for impedance matching. Therefore, The cost of manufacturing the dipole antenna is decreased. The electrical performance is improved.

DETAILED DESCRIPTION OF THE PREFERRED EMBODIMENT

Reference will now be made in detail to a preferred embodiment of the present invention.

Figure 1:
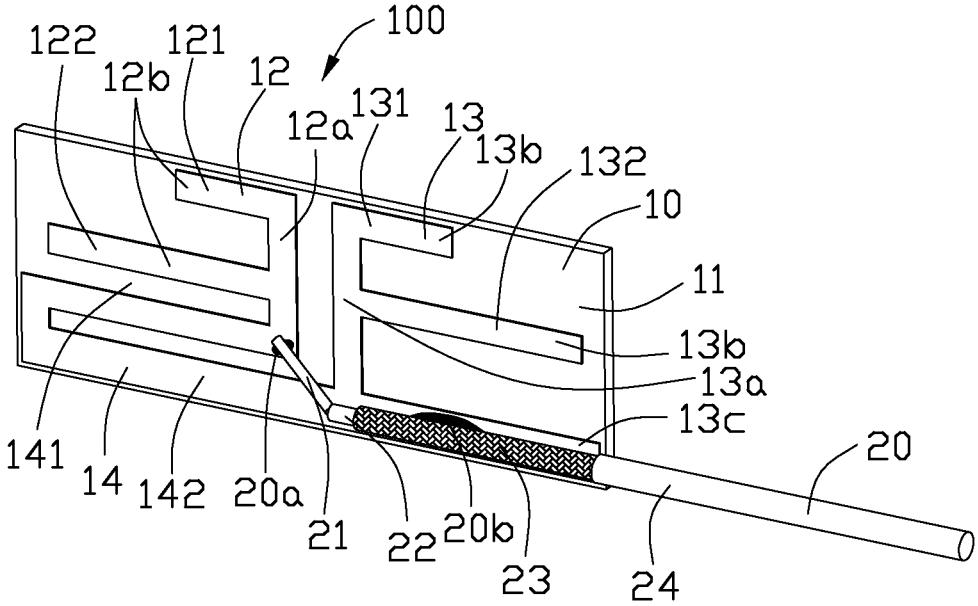
FIG. 1 is a perspective view of a first embodiment of dipole antenna assembly in accordance with the present invention.
Figure 2:
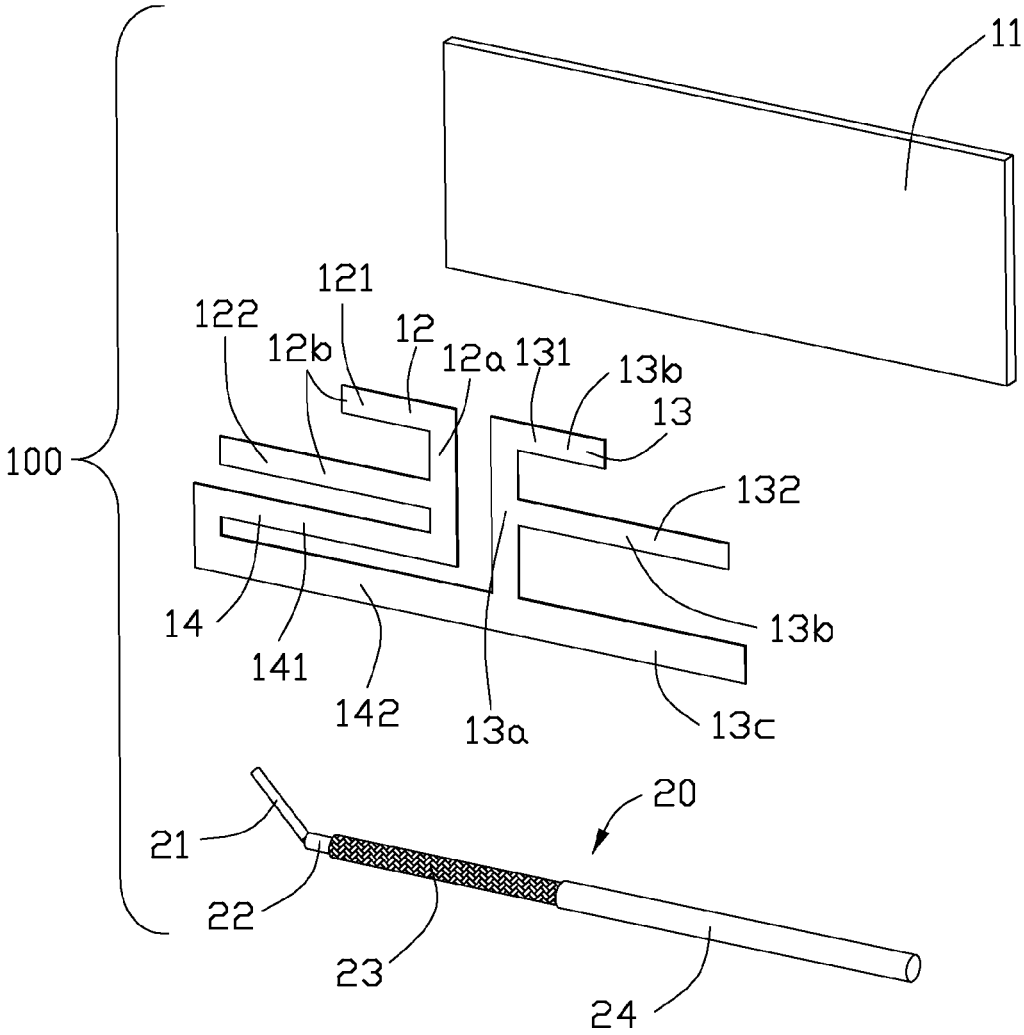
FIG. 2 is an exploded perspective view of the dipole antenna assembly as shown in FIG. 1.

Referring to FIGS. 1-2, a dipole antenna assembly 100 made in accordance with a first embodiment of the present invention comprises a dipole antenna 10 and a coaxial cable 20 or other feeding element connected with the dipole antenna 10.

The dipole antenna 10 comprises a substrate 11 or PCB, a radiation portion 12, a ground portion 13 and a circuit 14. The radiation portion 12, the ground portion 13 and the circuit 14 are disposed on a same surface of the substrate 11.

The radiation portion 12 comprises a first portion 12*a* extending along a third direction and a second portion 12*b* extending along a first direction perpendicular to the third direction. The second portion 12*b* comprises a first radiation element 121 operating at a first frequency band and a second radiation element 122 operating at a second frequency band. The first radiation element 121 connects with first end of the first portion 12*a*. The second radiation element 122 connects with a middle portion of the first portion 12*a*. The first radiation element 121 and the second radiation element 122 extend along a first direction.

The ground portion 13 comprises a third portion 13*a* extending along a third direction and separate from the first portion 12*a* of the radiation portion 12, a fourth portion 13*b* extending along a second direction opposite to the first direction, and a fifth portion 13*c* extending along the second direction. The fourth portion 13*b* comprises a first ground element 131 corresponding to the first radiation element 121 and a second ground element 132 corresponding to the second radiation element 122. The first ground element 131 connects with a first end of the third portion 13*a*. The second ground element 132 connects with a middle portion of the third portion 13*a*. The fifth portion 13*c* connects with a second end of third portion 13*a* opposite to the first end of the third portion 13*a*. The first radiation element 121 is aligned with the first ground element 131. The second radiation element 122 is aligned with the second ground element 132.

The coaxial cable 20 comprises a central conductor 21, an insulative layer 22 enclosing the central conductor 21, a shielding layer 23 enclosing the insulative layer 22, and a jacket 24 enclosing the shielding layer 23. The central conductor 21 electrically connects with radiation portion 12 at a first position 20*a*. The shielding layer 23 electrically connects with the ground portion 13 at a second position 20*b*. The coaxial cable 20 is soldered on the dipole antenna 10. The first position is located at a second end of second portion 12*a* opposite to the first end of the first portion 12*a*, or near the junction between the radiation portion 12 and the circuit 14. The second position is disposed at the fifth portion 13*c*, or near the junction between the ground portion 13 and the circuit 14.

The circuit 14 has one end connecting with the radiation portion 12 at the first position, and another end connecting with the ground portion 13 at the second position. The circuit 14 comprises a first trace 141 extending a distance from the first position 20*a* along the first direction, and a second trace 142 extending from the end of the first trace 141 to the second position 20*b*. The circuit 14 has a function for impedance matching that makes the dipole antenna have an improved electrical performance.

Figure 3:
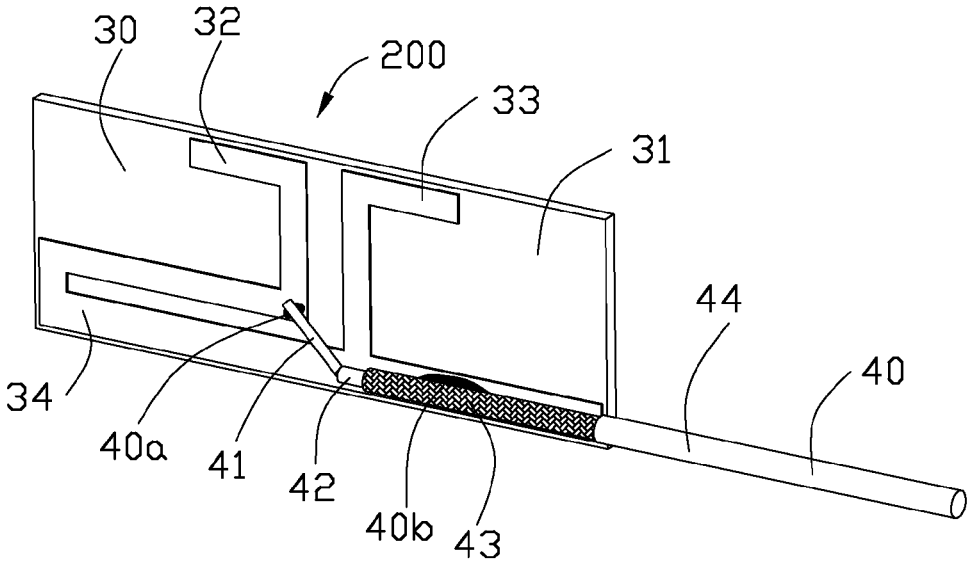
FIG. 3 is a perspective view of a second embodiment of dipole antenna assembly in accordance with the present invention.
Figure 4:
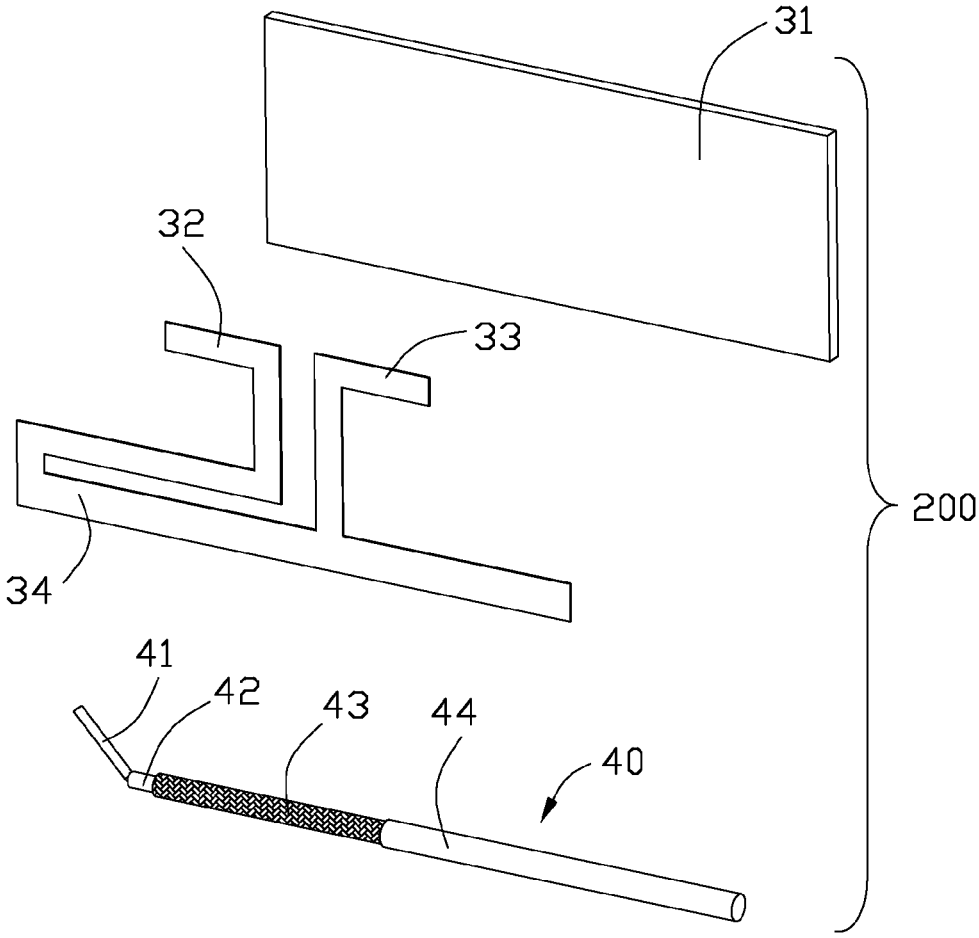
FIG. 4 is an exploded perspective view of the dipole antenna assembly as shown in FIG. 3.

Referring to FIGS. 3-4, a dipole antenna assembly 200 made in accordance with a second embodiment of the present invention comprises a dipole antenna 30 and a coaxial cable 40 or other feeding element connected with the dipole antenna 30.

The dipole antenna 30 comprises a substrate 31 or PCB, a radiation portion 32, a ground portion 33 and a circuit 34. The radiation portion 32, the ground portion 33 and the circuit 34 are disposed on a same surface of the substrate 31. The coaxial cable 40 comprise a central conductor 41, an insulative layer 42 enclosing the central conductor 41, a shielding layer 43 enclosing the insulative layer 42, and a jacket enclosing the shielding layer 43. The central conductor 41 is soldered on the radiation portion 32 at a first position 40*a*. The shielding layer 43 is soldered on the ground portion 33 at a second position 40*b*. The circuit 34 has one end connecting with the radiation portion 32 at the first position 40*a*, and another end connecting with the ground portion 33 at the second position 40*b*. The main distinction between the second embodiment and the first embodiment is that the dipole antenna 30 of second embodiment only has one radiation element 32 and one ground element 33. Other structures of the dipole antenna 30 of the second embodiment are same as the structure of the dipole antenna 10 of the first embodiment, and the detailed description is not conducted.

Figure 5:
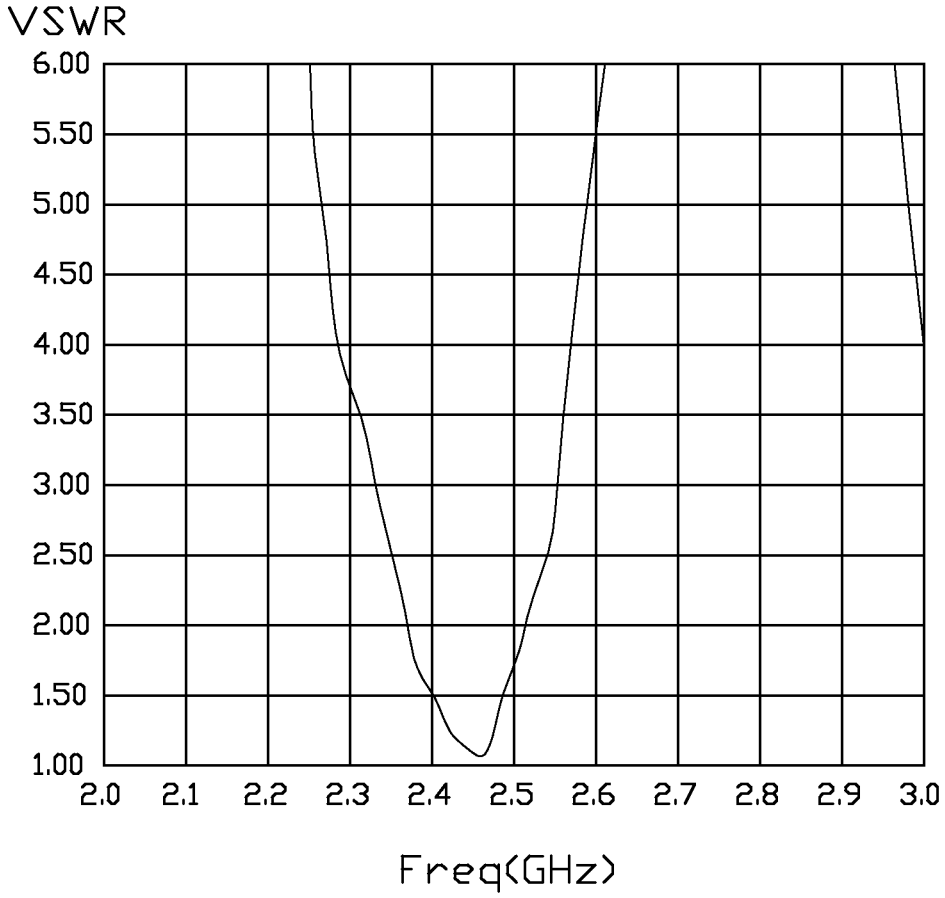
FIG. 5 is a test chart recording of Voltage Standing Wave Ratio (VSWR) of the second embodiment of dipole antenna assembly at different frequency.

FIG. 5 shows a test chart recording of Voltage Standing Wave Ratio (VSWR) of the second embodiment of dipole antenna assembly at different frequencies between 2 GHz and 3 GHz. The VSWR is lower than 2 in WLAN frequency band (2.4-2.5 GHz).

Figure 6:
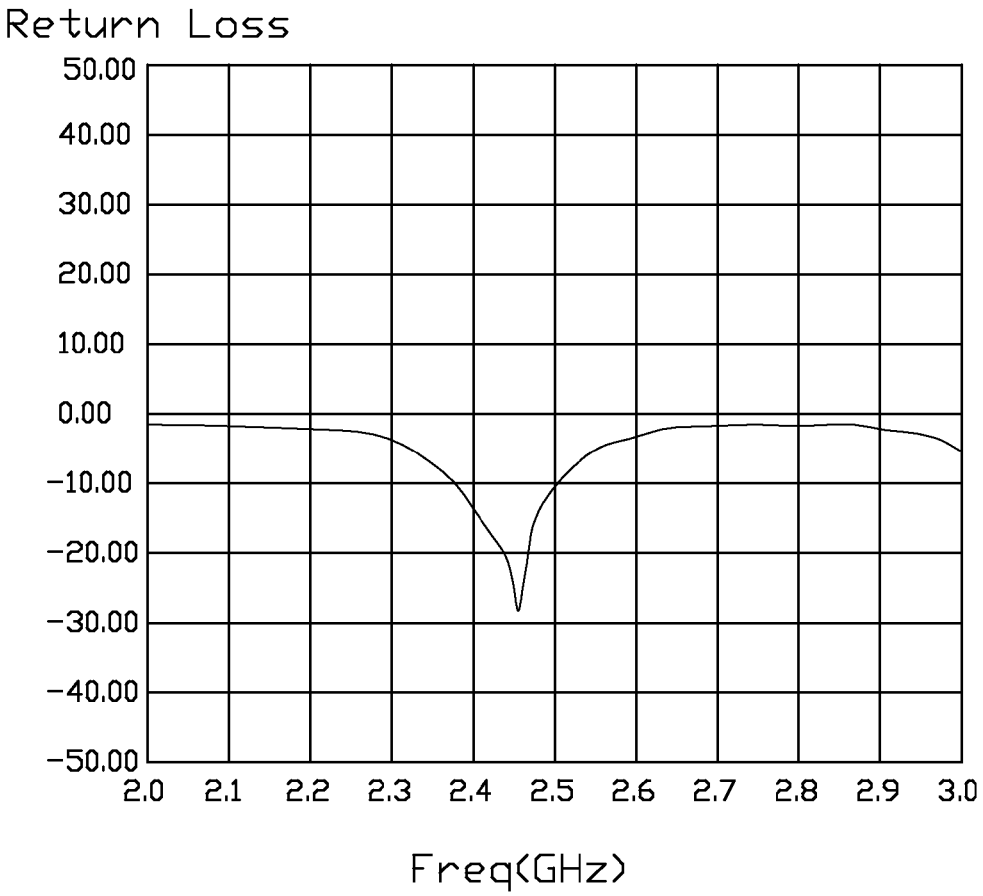
FIG. 6 is a test chart recording of Return Loss of the second embodiment of dipole antenna assembly at different frequency.

FIG. 6 shows a test chart recording of return loss of the second embodiment of dipole antenna assembly at different frequencies between 2 GHz and 3 GHz. The return loss is lower than −10 dB.

The circuits 14, 34 can be modified according to specific application of the antenna. The dipole antennae 10, 30 also can be manufactured by metal sheet.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dipole antenna assembly comprising:

a radiation portion and a ground portion laterally spaced from each other by two sides of an imaginary vertical center line;

a circuit trace having two opposite ends respectively linked to one corresponding end of said radiation portion and to a non-end portion of said ground portion; and a coaxial cable including an inner conductor and an outer conductor; wherein the inner conductor is mechanically and electrically connected around said corresponding end of the radiation portion while the outer conductor is mechanically and electrically connected to the ground portion; wherein said circuit trace is essentially as asymmetrically located on the same side with the radiation portion with regard to said imaginary vertical center line.

2. The dipole antenna assembly as claimed in claim 1, wherein said circuit trace defines two horizontal lines on which said two opposite ends are located.

3. The dipole antenna assembly as claimed in claim 1, wherein a position where the outer conductor is mechanically connected to the ground portion is proximate said non-end portion of the ground portion.

4. The dipole antenna assembly as claimed in claim 1, wherein said radiating portion is essentially symmetrical with a corresponding portion of said ground portion with regard to said vertical center line under condition that said corresponding portion is spaced away from said non-end portion of the ground portion.

5. The dipole antenna assembly as claimed in claim 4, wherein said radiating portion includes one vertical section which is parallel to the imaginary vertical center line and is equipped with said corresponding end, and at least one horizontal line extending horizontally from said vertical center line away from the imaginary vertical center line.

6. A dipole antenna assembly comprising:

an L-shaped radiating portion and another L-shaped ground portion being essentially laterally symmetrical with each other relative to an imaginary vertical center line;

said ground portion further extending away from the radiating portion around a bottom portion thereof;

a horizontally lying U-shaped circuit trace linked at a bottom portion of said radiating portion and said the bottom portion of said ground portion; and a coaxial cable having an inner conductor mechanically and electrically connected to a first position proximate the bottom portion of the radiating portion for signal transmission and an outer conductor mechanically and electrically connected to a second position on said ground portion proximate the bottom portion thereof for grounding.

7. The dipole antenna assembly as claimed in claim 6, wherein said horizontally lying U-shaped circuit is asymmetrically located on a same side with the radiating portion with regard to the vertical center line.

* * * * *